US006301715B1

(12) United States Patent
Hoffmann

(10) Patent No.: US 6,301,715 B1
(45) Date of Patent: Oct. 16, 2001

(54) GLOVE FOR PILOTS

(75) Inventor: Marianne Hoffmann, Düsseldorf (DE)

(73) Assignee: Blücher GmbH, Erkrath (DE)

( * ) Notice: Subject to any disclaimer, the term of this patent is extended or adjusted under 35 U.S.C. 154(b) by 0 days.

(21) Appl. No.: 09/629,593

(22) Filed: Jul. 31, 2000

(30) Foreign Application Priority Data

May 4, 2000 (DE) ..... 200 08 047

(51) Int. Cl.[7] ..... A41D 19/00
(52) U.S. Cl. ..... 2/161.8; 2/163; 2/167
(58) Field of Search ..... 2/16, 21, 159, 2/161.1, 161.3, 161.5, 161.6, 161.7, 161.8, 163, 167, 169

(56) References Cited

U.S. PATENT DOCUMENTS 3,961,377 * 6/1976 Lars-Jos ..... 2/169
4,670,330 * 6/1987 Ishiwata ..... 428/290
5,231,700 * 8/1993 Cutshall ..... 2/161.7
5,925,441 * 7/1999 Blauer et al. ..... 428/196
6,029,276 * 2/2000 White ..... 2/161.6
6,044,493 * 4/2000 Post ..... 2/167
6,052,829 * 4/2000 Kindler ..... 2/167
6,154,885 * 12/2000 Kobayashi et al. .

* cited by examiner

*Primary Examiner*—John J. Calvert
*Assistant Examiner*—Katherine Moran
(74) *Attorney, Agent, or Firm*—Cohen, Pontani, Lieberman & Pavane

(57) ABSTRACT

A glove is provide having a first piece of material for covering a front of a hand and a second piece of material for covering a back of a hand. The first piece of material is formed in the shape of a hand having fingers and extends more than half way around the circumference of each finger and has a narrower tip near a top of each finger. The narrower tip extends beyond the top of each finger. The second piece of material is formed in the shape of a hand having fingers and extends less than half way around the circumference of each finger and below the top of each finger. The first piece of material and the second piece of material are attached at an edge of each piece to form a seam that falls on the back of the hand when the glove is worn. Optionally, at least the first piece of material is lined with an adsorption layer for sorbing chemicals.

26 Claims, 2 Drawing Sheets

GLOVE FOR PILOTS

BACKGROUND OF THE INVENTION

1. Field of the Invention

The present invention relates to a glove having excellent tactility. More particularly, the present invention is a glove having seams remote from finger tips and made of material which allows for optimized tactility.

The importance of protecting military pilots against chemical warfare agents cannot be underestimated. It is not difficult to contaminate an entire airfield. Even if the interior of an aircraft can be kept relatively "clean", the pilot may come into contact with chemical warfare agents on the way to his seat. Epispastic skin poisons, such as, for example, mustard gas (Yperite, yellow cross gas) are especially unpleasant. If the hands have been contaminated, the pilot cannot pilot an aircraft for weeks, because his hands lack all sensitivity. This risk cannot be underestimated, and therefore a great amount of care must be devoted to protecting the hands. So that the glove protects against skin poisons, an adsorption layer must be present, as in chemical protection clothing. In order to avoid local perforations caused by liquid warfare agents, a good hydrophobic and oleophobic finish is recommended. On the other hand, it must be possible for the pilot to operate his instruments unimpeded, which means that a high degree of tactility must be maintained.

A soft glove, which is designed so that it makes it possible to actuate small switches, knobs, instruments, etc. requiring a "fingertip feel", is, however, also preeminently suitable for a whole range of civil applications.

2. Description of the Related Art

Gloves having a seam along the sides and over the tops of fingertips are known. However, these gloves due to their design, can impede tactility, especially at the finger tips. This is undesirable for use by pilots who require tactility to operate airplane switches and the like.

Gloves that are impervious to certain chemicals are also known. However, the chemically impervious gloves are designed to be impermeable to water vapor. This can cause sweating inside the glove and interfere with tactility. In addition, known chemically impervious gloves are often too thick to allow sufficient tactility.

As a result, there is a current need for gloves that offer a certain degree of protection from harmful chemical agents while maintaining a high degree of tactility.

SUMMARY OF THE INVENTION

An object of the present application is to develop a glove, which in no way impairs the ability to operate a wide variety of instruments and knobs. The glove should be permeable to water vapor.

Briefly stated, the present invention is directed to a glove having a first piece of material for covering a front of a hand and a second piece of material for covering a back of a hand. The first piece of material is formed in the shape of a hand having fingers and extends more than half way around the circumference of each finger and has a narrower tip near a top of each finger. The narrower tip extends beyond the top of each finger. The second piece of material is formed in the shape of a hand having fingers and extends less than half way around the circumference of each finger and below the top of each finger. The first piece of material and the second piece of material are attached at an edge of each piece to form a seam that falls on the back of the hand when the glove is worn.

The object is achieved, on the one hand, by the choice of particularly soft materials and, on the other hand, by a special cut. The latter was developed so that no seams disturb the "fingertip feel". This was achieved by drawing the material of the underside upward over and beyond the fingertip to a point where seams no longer cause any disturbance.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters identify-similar elements throughout the several views.

DETAILED DESCRIPTION OF THE PRESENTLY PREFERRED EMBODIMENTS

Figure 1:
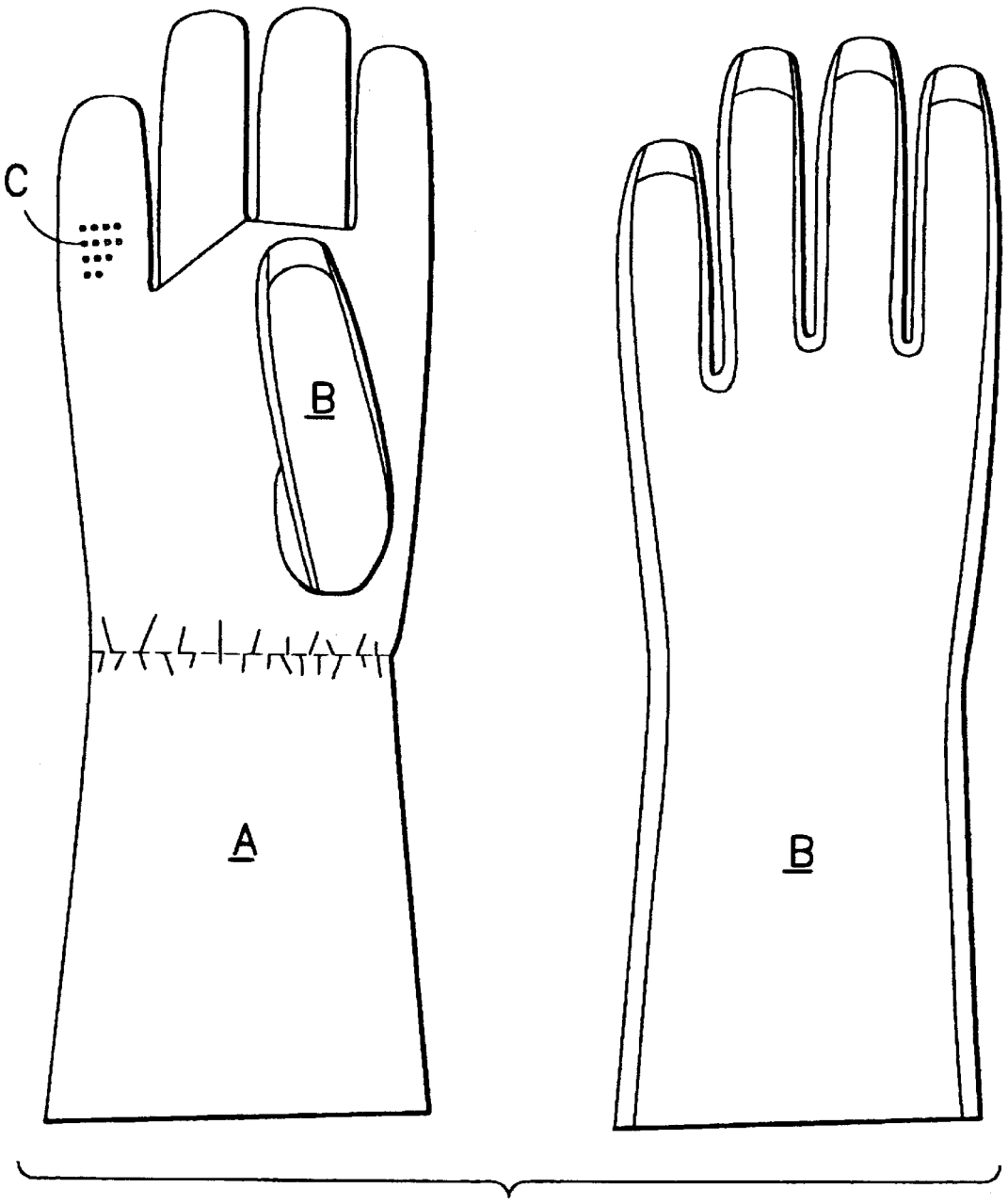
FIG. 1 depicts the finished glove.

Referring to FIG. 1, a front of the glove A is shown illustrating that there are no seams in the area of finger tips that could interfere with tactility. A back of the glove B is shown illustrating that the seams of the glove are designed to fall on the back of the hand.

Figure 2:
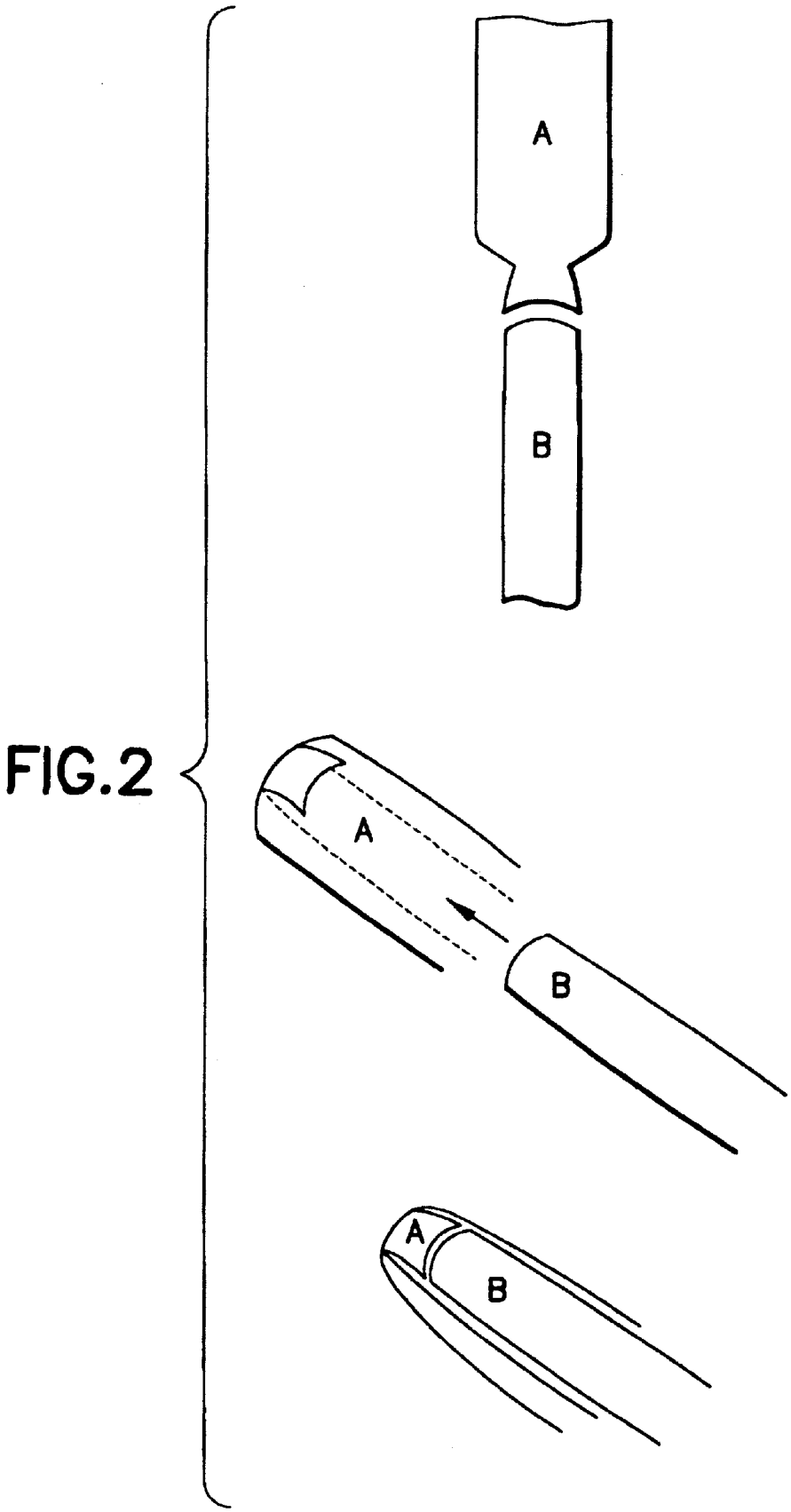
FIG. 2 illustrates how the seams of the fingers of the glove are cut.

Referring now to FIG. 2, a front of the glove A folds over the tip of the finger and also wraps around the finger toward the back of the hand and a seam is formed on the back of the glove B. The absorption layer may be produced by a method known for chemical protection clothing. For example, a spheroidal highly abrasion-resistant activated charcoal with a mean diameter of around 0.5 mm is bonded to a carrier material with the aid of an adhesive applied in spots and is provided with a light covering. The carrier material itself is preferably a longitudinally elastic warp fabric composed of skin-compatible fibers, for example cotton, with a weight of usually 100±30 g/m$^2$. The covering may, for example, be a light knitted cloth. The exterior material may be very soft leather or a sufficiently stretchable textile material. The thickness, structure and fibrous material of the glove material may vary within wide limits, so that a person skilled in the art may select among a wide variety of appropriate materials.

In a preferred embodiment, the grip may be increased by means of spots, nubs or bumps C of a moderately soft plastic which are printed on the front of the glove (the side opposite the back of the hand). As an example, Impranil HS 62 which has been cross-linked with Impranil HSC and had been printed by means of a 14-mesh screen (coating 50–100 g/m$^2$) may be used.

In a further preferred embodiment, soft goatskin is used for the front (the side opposite the back of the hand). A good hydrophobic and oleophobic finish already affords good protection without an adsorption layer. For the side covering the back of the hand, an air-permeable textile material is used which is lined with the adsorption layer already described.

In another embodiment, the leather, too, is lined with an adsorption layer.

In yet another embodiment, instead of leather, a hard-wearing longitudinally elastic material is used which may have a hydrophobic and oleophobic finish.

Finally, in an embodiment for civil applications, there is no adsorption layer at all.

All the embodiments have in common the fact that the fingertips are free of disturbing seams.

The invention is not limited by the embodiments described above which are presented as examples only but can be modified in various ways within the scope of protection defined by the appended patent claims.

What is claimed is:

1. A glove having a high degree of tactility and being protective against chemical agents, comprising:

a first piece of material for covering a front of a hand;

a second piece of material covering a back of the hand; and an adsorption layer for sorbing chemicals, the first piece of material being formed in the shape of a hand having fingers and extending more than half way around the circumference of each finger and has a narrower tip near a top of each finger, the narrower tip extending beyond the top of each finger, the second piece of material being formed in the shape of a hand having fingers and extending less than half way around the circumference of each finger and below the top of each finger, the first piece of material and the second piece of material being attached at an edge of each piece to form a seam that falls on the back of the hand when the glove is worn.

2. The glove according to claim 1, wherein the adsorption layer comprises:

a carrier material of an air permeable longitudinally elastic wrap fabric composed of skin compatible fibers having a weight of about (100±30) g/m$^2$;

an adhesive compound placed on the carrier material;

a granular adsorbent fixed to the textile material by the adhesive compound at a concentration of from about 100 g/m$^2$ to about 200 g/m$^2$; and a light covering of an elastic fabric on the granular adsorbent.

3. The glove according to claims 2, wherein said granular adsorbent is spheroidal in shape.

4. The glove according to claim 3, wherein said granular adsorbent is activated charcoal.

5. The glove according to claim 4, wherein the granular adsorbent is highly abrasion-resistant activated charcoal with a mean diameter of about 0.5 mm.

6. The glove according to claim 1, wherein said adsorption layer forms a lining of the glove.

7. The glove according to claim 6, wherein at least one of the first piece of material and the second piece of material is lined with said adsorption layer.

8. The glove according to claim 1, wherein at least one of the first piece of material and the second piece of material is made from soft leather.

9. The glove according to claim 8, wherein the at least one piece of material has a hydrophobic and oleophobic finish.

10. The glove according to claim 1, wherein at least one of the first piece of material and the second piece of material is made from an air-permeable, longitudinally elastic material that is skin compatible.

11. The glove according to claim 10, wherein the at least one piece of material further comprises a hydrophobic and an oleophobic finish.

12. The glove according to claim 1, wherein both the first piece of material and the second piece of material comprise a hydrophobic and an oleophobic finish.

13. The glove according to claim 1, and further comprising bumps of a plastic material formed on the first piece of material on an exterior of the glove for increasing the grip of the glove.

14. The glove according to claim 1, wherein said glove is permeable to water vapor.

15. A glove having a high degree of tactility and being protective against chemical agents, comprising:

a first piece of material for covering a front of a hand;

a second piece of material for covering a back of the hand; and an adsorption layer for sorbing chemicals, the first piece of material being a soft leather formed in the shape of a hand having fingers and extending more than half way around the circumference of the finger and having a narrower tip near a top of each finger, the narrower tip extending beyond the top of each finger, the second piece of material being a longitudinally elastic, air-permeable and skin compatible textile formed in the shape of a hand having fingers and extending less than half way around the circumference of each finger and below the top of each finger, the first piece of material and the second piece of material being attached at an edge of each piece to form a seam that falls on the back of the hand when the glove is worn.

16. The glove according to claim 15, wherein the adsorption layer comprises:

a carrier material of an air permeable longitudinally elastic wrap fabric composed of skin compatible fibers having a weight of about (100±30) g/m$^2$;

an adhesive compound placed on the carrier material;

a granular adsorbent fixed to the textile material by the adhesive compound at a concentration of from about 100 g/m$^2$ to about 200 g/m$^2$; and a light covering of an elastic fabric on the granular adsorbent.

17. The glove according to claims 16, wherein said granular adsorbent is spheroidal in shape.

18. The glove according to claim 17, wherein said granular adsorbent is activated charcoal.

19. The glove according to claim 18, wherein the granular adsorbent is highly abrasion-resistant activated charcoal with a mean diameter of about 0.5 mm.

20. The glove according to claim 15, wherein said adsorption layer forms a lining of the glove.

21. The glove according to claim 20, wherein at least one of the first piece of material and the second piece of material is lined with said adsorption layer.

22. The glove according to claim 21, wherein both the first piece of material and the second piece of material are lined with an adsorption layer.

23. The glove according to claim 15, wherein at least one of the first piece of material and the second piece of material comprises a hydrophobic and oleophobic finish.

24. The glove according to claim 23, wherein both the first piece of material and the second piece of material comprise a hydrophobic and oleophobic finish.

25. The glove according to claim 15, and further comprising bumps of a plastic material formed on the first piece of material on an exterior of the glove for increasing the grip of the glove.

26. The glove according to claim 15, wherein said glove is permeable to water vapor.

* * * * *